US005429413A

United States Patent [19]

Levy et al.

[11] Patent Number: 5,429,413

[45] Date of Patent: Jul. 4, 1995

[54] FOLDING LOUNGE CHAIR

[76] Inventors: Lionel Levy, 15, rue Grandville, F-94160 Saint-Mande, France; Kevin S. Steiner, 320 E. Shore Rd., Great Neck, N.Y. 11023

[21] Appl. No.: 961,913

[22] PCT Filed: May 29, 1991

[86] PCT No.: PCT/FR91/00423

§ 371 Date: Jan. 4, 1993

§ 102(e) Date: Jan. 4, 1993

[87] PCT Pub. No.: WO91/18540

PCT Pub. Date: Dec. 12, 1991

[30] Foreign Application Priority Data

Jun. 10, 1990 [FR] France ..... 90 06843
Feb. 1, 1991 [FR] France ..... 91 01183

[51] Int. Cl.[6] ..... A47C 4/28

[52] U.S. Cl. ..... 297/45; 297/16.2; 297/51

[58] Field of Search ..... 297/16.1, 16.2, 17, 297/42, 44, 45, 51, 53; 5/114, 116

[56] References Cited

U.S. PATENT DOCUMENTS

| | | | |
|---|---|---|---|
| 180,610 | 8/1876 | Lungren | 297/16.2 X |
| 237,306 | 2/1881 | Nichols | 5/116 |
| 270,961 | 1/1883 | Martial | 5/114 |
| 600,647 | 3/1898 | Niemeyer | 5/114 |
| 643,137 | 2/1900 | Hutchinson | 5/116 |
| 1,422,319 | 7/1922 | Stoll | 297/16.2 X |
| 1,569,728 | 1/1926 | Douglas et al. | 5/116 |
| 2,128,018 | 8/1938 | Skidmore . | |
| 2,254,939 | 9/1941 | Elias . | |
| 2,757,386 | 8/1956 | Lappin . | |
| 3,965,502 | 6/1976 | Bertram | 5/114 X |
| 4,801,176 | 1/1989 | Wolberg | 297/45 X |
| 4,826,241 | 5/1989 | Barras | 297/16.2 |

FOREIGN PATENT DOCUMENTS

| | | | |
|---|---|---|---|
| 0052031 | 5/1982 | European Pat. Off. | 297/16.2 |
| 0781332 | 2/1935 | France | 5/114 |
| 2532535 | 3/1984 | France | 297/16.2 |
| 0588076 | 5/1947 | United Kingdom | 297/44 |

*Primary Examiner*—Kenenth J. Dorner
*Assistant Examiner*—Milton Nelson, Jr.
*Attorney, Agent, or Firm*—Browdy and Neimark

[57] ABSTRACT

A folding lounger with a frame having parallel longitudinal elements each of which is provided with two hinges defining a central portion forming the seat to which are hinged folding legs. The frame also has an upper portion and a lower portion each of which includes a fabric stretched between the two longitudinal elements, as well as at least two supporting crossbars arranged one at each end of the frame. The folding legs are mounted at each end of the seat on joints fastened to the respective hinges the joints being provided so that the folded legs can be juxtaposed in pairs. Support bars are provided with a joint so they can lie alongside the longitudinal elements to allow them to be brought together on folding, whereby the fabric becomes slack and lies outside the structure to avoid being damaged when the lounger is fully folded. The lounger further comprises locking devices for locking and stabilizing the chair when it is fully unfolded and ready for use.

7 Claims, 6 Drawing Sheets

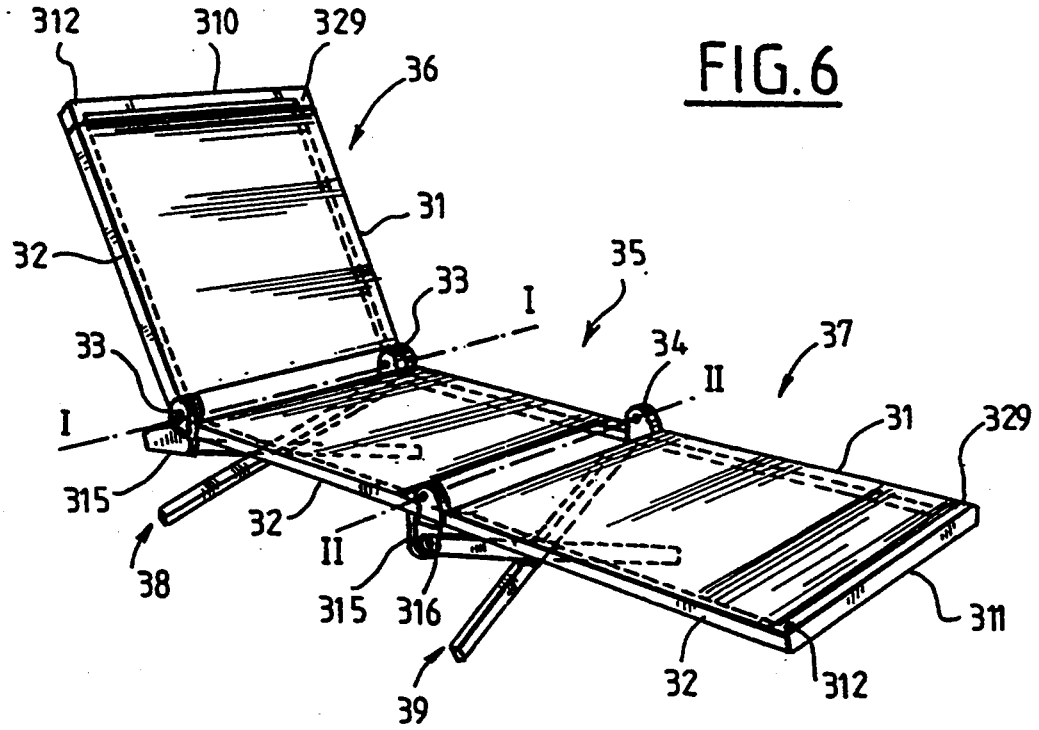
FIG.6
FIG.7
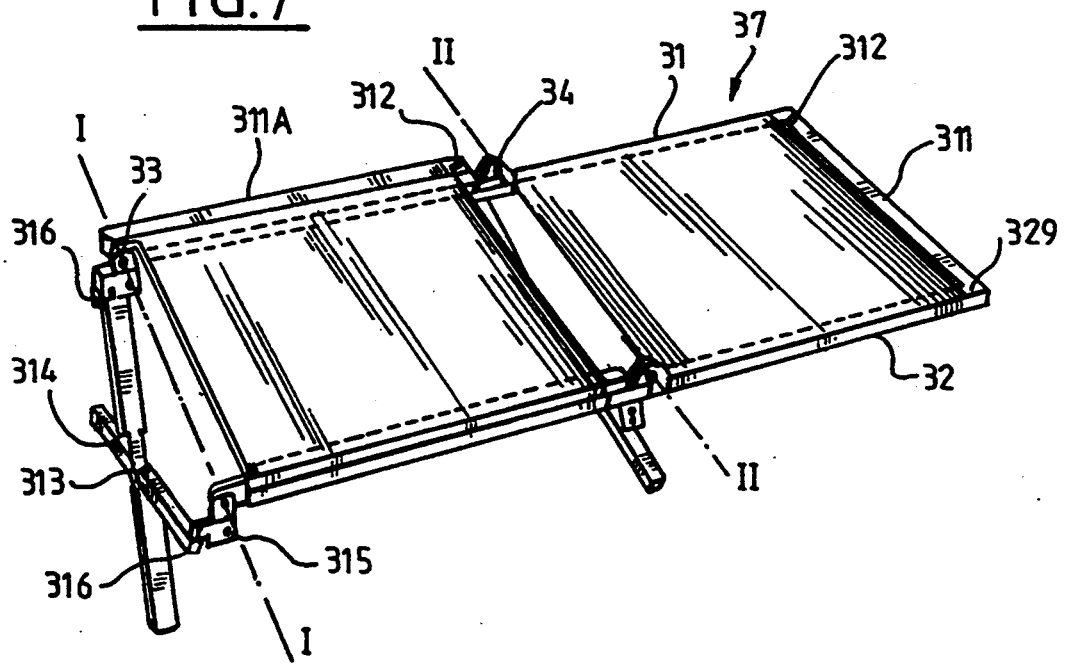

FOLDING LOUNGE CHAIR

FOLDING LOUNGE CHAIR

The present invention relates to a lounge chair capable of being folded to a reduced and compact form, simple to use and easy to carry.

PREVIOUS TECHNIQUE

The folding of a lounge chair is traditionally done by folding the lower portion over the middle one and the upper portion over the two previous portions. Thus, the patent U.S. Pat. No. 4,773,708 describes a folding lounge chair with a frame composed of two parallel longitudinal elements, each of which is provided with two hinges located at each end of the central portion forming the seat, to which are hinged folding legs.

The upper and lower portions located on each side of the seat are composed in one single piece by the longitudinal elements and a support bar at each end. Each of these portions includes a fabric stretched between the two longitudinal elements. The reduction of the volume according to this technique is limited to the size of the seat, because the support bars and the folding legs prevent the longitudinal elements from being brought together.

SUMMARY OF THE INVENTION

The lounge chair, according to the invention, remedies these inconveniences, thanks to a folding device allowing the folding lengthwise and a transversal reduction to give the chair a compact configuration, easy to carry. The lounge chair, according to the invention, is the type that is formed by a frame that has parallel longitudinal elements each of which is provided with two hinges defining a central portion forming the seat to which are jointed folding legs, an upper portion and a lower portion, each of which includes a fabric stretched between the longitudinal elements, the frame including also at least two supporting crossbars arranged at its extremities, the folding legs are mounted at each end of the seat on joints fastened to the respective hinges, these joints allowing the legs once folded to be juxtaposed in pairs, the supporting bars are provided with a joint allowing them to lie alongside the longitudinal elements, to allow them to be brought together on folding, and the placing of the slack fabrics which then lie outside the structure. The lounge chair, in accordance with the invention, comprises locking devices for locking and stabilizing the chair when it is fully unfolded and ready for use.

In accordance with a first form of realization, each crossbar is provided at one end with a joint to the longitudinal element, or the respective leg, as well as with a locking device at each end. The said locking device has a pin activated by a button located on the side of each longitudinal element, and on the side of each leg opposite to the one that has the pin. The fabrics are fastened to one of the longitudinal elements on the same side of the frontal frame for each of them, and received through the other longitudinal element. Preferably each fabric is introduced inside a slot present in the structure of the element parallel to the one where it is fastened. Each support bar is provided with a canal in which is inserted the head of a bolt fastened to each leg and each longitudinal structure, this canal ends in an arc on the side of the joint to the support bar. The two longitudinal elements are provided on the outer side of their lower and upper portion, with a recess so that the two crossbars, once folded, locate themselves in it, and a compact block is realized. Each fabric is provided at its free end with a strong rod equipped with a ring in its middle, which locks itself against the slots when opening the longitudinal structures, thus the closing of these structures takes effect by a traction exerted on these rings. A shoulder strap fastened to the folded lounge chair allowing to secure the fabrics encircling the lounge chair thanks to a strip with spikes and facilitates its transportation. The invention foresees also an automatic rolling up device with springs located inside the longitudinal element intended to receive the fabrics.

In accordance with a second form of realization, the folding crosslegs are cruciform, provided with a free articulation in the middle of their branch, one end of each branch is linked to a longitudinal element of the seat with connection joints fastened to each hinge, each of which hinge has two rotating axles, more or less perpendicular, one of these allowing to hinge the legs to the longitudinal elements of the seat, the other one allowing the opening and the closing of the branches at the level of their own median joint, moreover each connection joint is composed of locking sides, surface against surface, provided so that the chair is stabilized when fully unfolded. The connection joints are the ,type with an intermediary piece carrying the rotating axles, two of which are provided with two extensions mounted at an angle, tile two other upright. These different joints are arranged in pairs facing each other on the opposite longitudinal elements. The locking sides surface against surface are respectively arranged on the middle piece so they can be brought against the sides carried by one of the hinges and by the end of the branch of the corresponding leg, to which it is hinged. The two branches of a leg are mounted on the same plane and present a profile such as they can be juxtaposed when closed. The invention also foresees that each crossbar forms a telescopic extension from a longitudinal element, inwardly composed by guides for the joint axle and by components to hold back this axle when the chair is opened, or that each support bar is able to be disconnected from the longitudinal element to locate itself alongside the latter, thanks to an elastic holding device when the chair is folded, and hook at the extremities of the longitudinal elements, maintaining the opening distance of the frame when unfolded.

BRIEF DESCRIPTION OF THE DRAWINGS

Other characteristics and advantages of the invention will emerge from the following description of preferred forms of realization, done at sight of the figures appended.

FIG. 6 represents a schematic view in perspective of a second form of realization of a folding lounge chair, fully unfolded, ready for use.

FIG. 7 represents a schematic view in perspective of the chair in FIG. 6, on which one portion has been folded over the central seat.

In these figures, the same references indicate the same elements.

POSSIBILITIES OF REALIZING THE INVENTION

Figure 1:
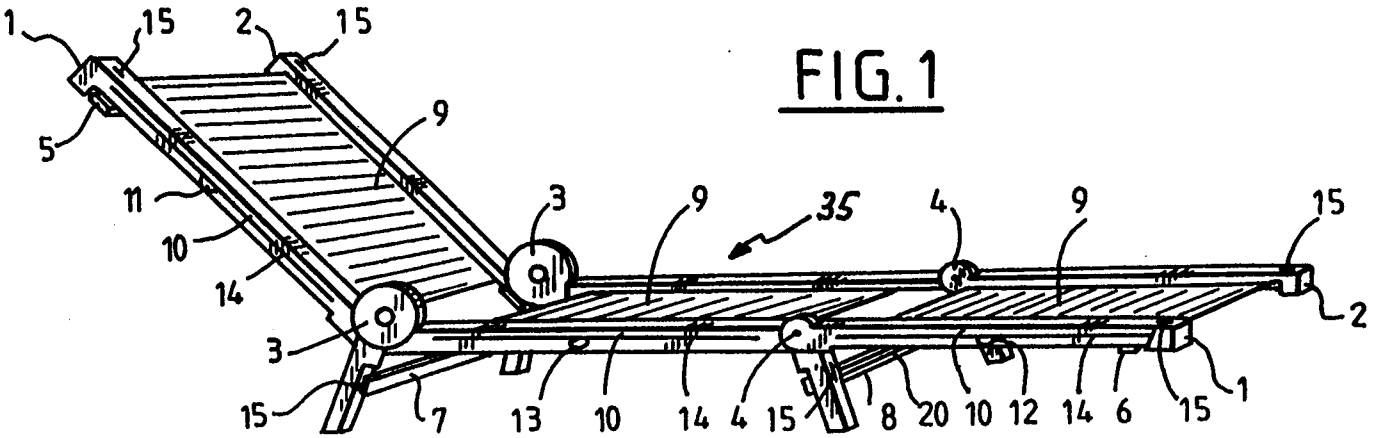
FIG. 1 represents a view in perspective of a chair according to the first form of realization, unfolded lengthwise and widthwise.
Figure 2:
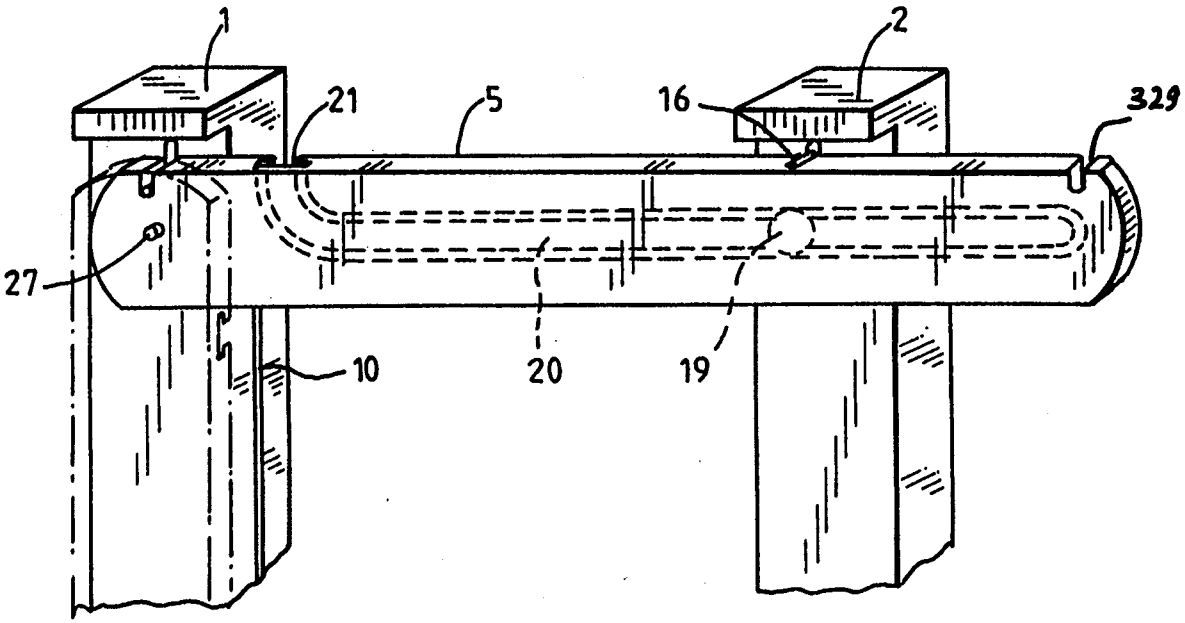
FIG. 2 represents a view in perspective of the trajectory of one of the two longitudinal elements alongside one of the support bars when folding the chair.

Referring to FIGS. 1 to 5, and in accordance with the first form of realization, a folding lounge chair, in accordance with the invention, has two parallel longitudinal elements 1 and 2, jointed with four hinges 3 and 4, allowing the folding of the ensemble lengthwise, and the folding of two legs along the central portion 35 on the outer side. The hinges 4, in accordance with the invention, when the chair is unfolded show a fixed and final opening of 186. The hinges 3 allow the adjustment of the incline of the upper portion of the frontal frame, by several gradually fixed positions. The two longitudinal elements are connected with two perpendicular support bars 5 and 6 forming frontal uprights. In the same way, the legs are connected in pairs with respectively two support bars 7 and 8, parallel to the frontal uprights 5 and 6, fastened perpendicularly to each of them. The three fabrics 9, are attached to the longitudinal elements 2. They are provided with a sliding channel, sewn along their ends parallel to the longitudinal structure of the ensemble, in which comes a rod 14, provided with a ring 11, 12 and 13 in its middle, allowing, according to the invention, the fabric to be pulled through a slot 10, provided therefore across the longitudinal element 1. A locking device, shown in FIG. 2, has on one side of a longitudinal element 2, a button 15, activating a pin 16, on the opposite side. Such an ensemble is repeated eight times along the whole structure. Two controls, set back at the upper ends of the longitudinal elements, activate the system, two others, set back at the lower end of these same elements, and four others, one on each of the uprights of the legs, on their upper portion, on the side opposite to the one where are fastened the respective supporting bars, provide the same function. FIG. 2 represents the folding mechanism of the device in its width. It concerns as well the bringing together of the two elements 1 and 2 as well as the parallel legs between them. Support bar 5 is provided, in accordance with the invention, with an internal canal 20, which depth is equal to half of the thickness of this bar, where a bolt 19, fastened to element 2, has its head emprisoned in this canal, but is able to circulate, thus causing the displacement of element 2. On the side of element 1, the canal presents an arc directed towards the upper portion of upright 5, where it emerges. While the two longitudinal elements are brought together, bolt 19, evolving within canal 20, has access to this arc leading it outside.

Figure 3:
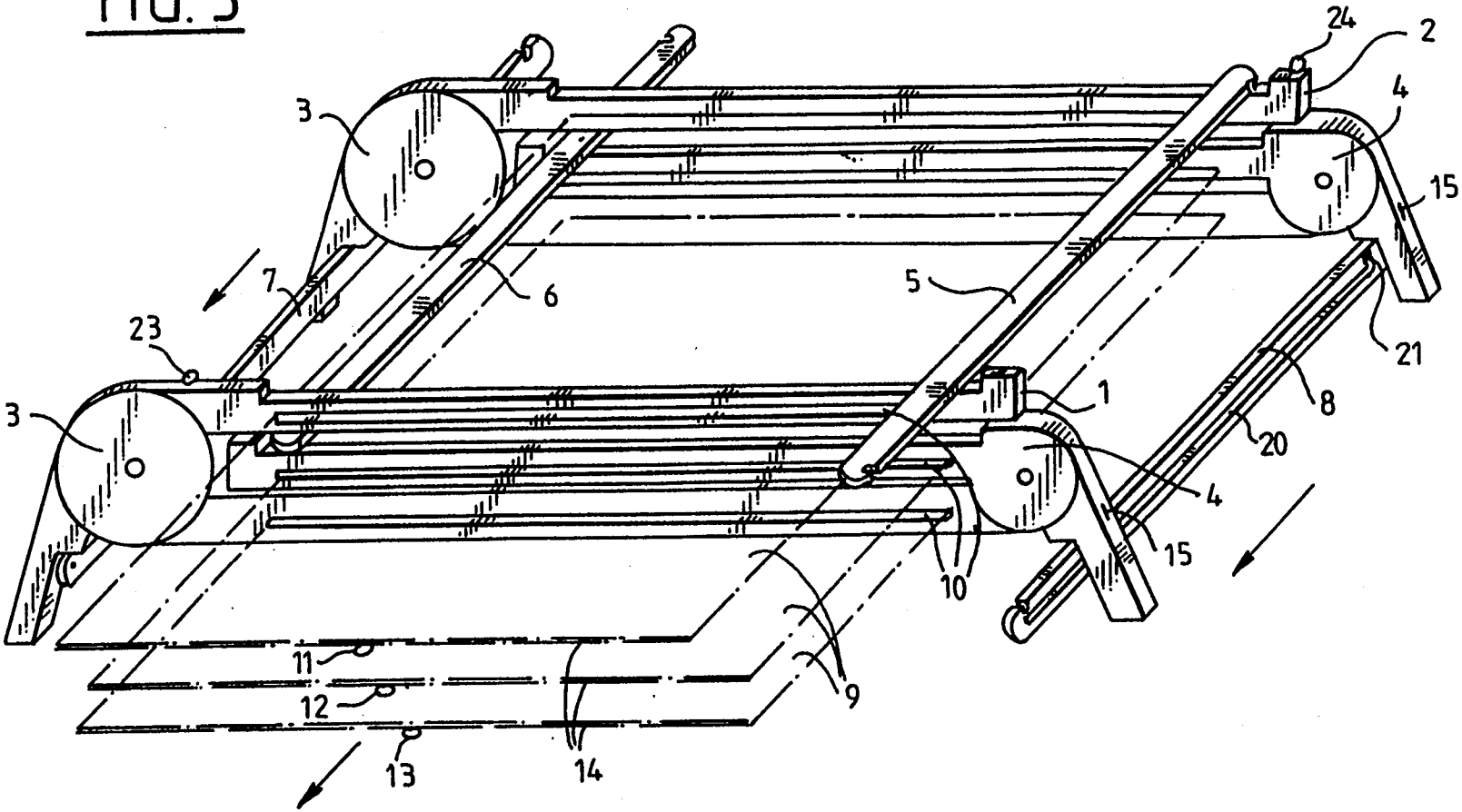
FIG. 3 represents a view in perspective of the chair in accordance with FIG. 1, in the process of folding the chair lengthwise and widthwise.
Figure 4:
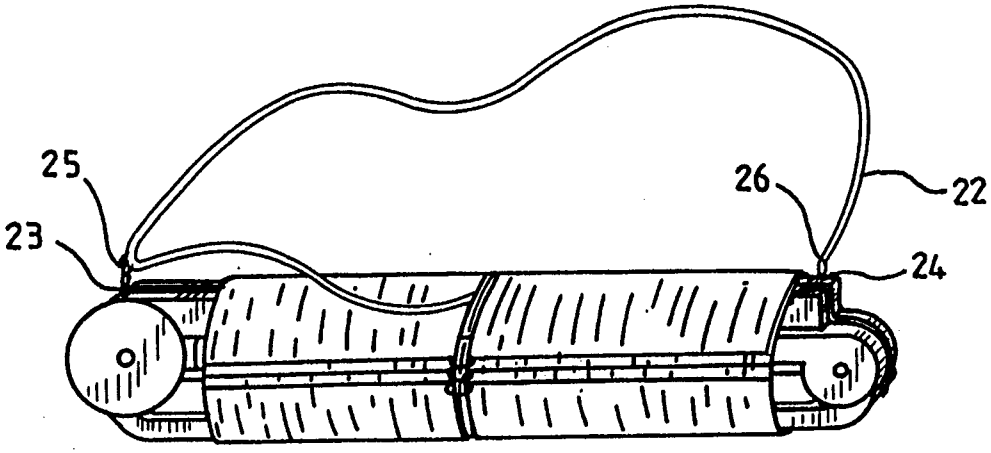
FIG. 4 represents a view in perspective of the chair in its fully folded position, the fabrics being rolled around the structure and surrounded by a band continuing as a shoulder strap.
Figure 5:
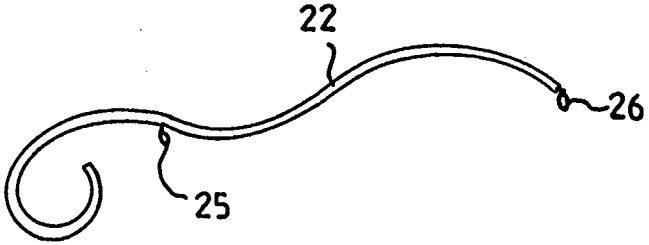
FIG. 5 represents a schematic view of the surrounding band of the compact structure.

When revolving lightly the bar downwards, bolt 19 is driven out canal 20, and leaves it by aperture 21, separating the bar from element 2. The upright thus liberated revolves downwards thanks to an assembling peg 27, until it is lined up with element 1. marrying the recess provided for this purpose. The folding method of the whole structure, according to the invention, requires at first the unlocking of bar 6, before the folding of the lower portion over the central portion, then the unlocking of bar 5, before the folding of the upper portion over the lower portion, at last, the unlocking of bars 7 and 8. At this point of the process, the three rings 11, 12 and 13 are lined up on the same vertical plane. Referring to FIG. 3, a traction perpendicular to the longitudinal elements 1 and 2, exerted on the three rings 11, 12 and 13, simultaneously, allows the bringing together of the two longitudinal elements, reducing gradually the lateral size of the folded chair. This movement owes its stability and its reliability to the canals 20 of the four support bars thus transformed into security rails for the movement. The two bars 5 and 8 are then overhanging, perpendicular to the ensemble of folded elements, on the side of the fabric, and bars 6 and 7 are overhanging, on the opposite side. It is when the two folded elements are brought together, that the four supporting bars, in accordance with the process explained in reference to FIG. 2, are liberated. Bar 5 is folded along the outer side of the upper portion of element 2, and bar 6 locates itself along the outer side of the lower portion of element 1. Bar 8, has then revolved, and is lined up along the leg connected with joint 4, joining the lower portion of element 2 to the middle portion. The ensemble leg plus bar, thus formed, revolves until located below the central portion of element 2. In the same way, bar 7, accompanied by the opposite leg, is now arranged below the central portion of element 1. The fabrics are now all on the same side, rolled around the structure thus compact, the fabric that has ring 13 surrounding the other ones. FIG. 4 represents the chair in accordance to this configuration, with a separate band 22 that allows to surround the chair. This band passes through the three rings 11, 12 and 13 to avoid a lateral movement of the band. It is for example provided with a portion of band that has pins, sold under the name VELCRO, locking the surrounding, as well as with two clips 25 and 26. The clip 25 far enough, to avoid any tension on the VELCRO part, clips to hook 23, located on the outer side of the upper portion of element 1, at the beginning of this portion, the other clip 26, at the end of band 22, gets fastened to hook 24, located on the outer side of the upper portion of element 2 at the end of this portion. This band or shoulder strap thus fixed, renders the device very, easy to be carried by the user.

In accordance with a variant, the device may include a hinge jointing the lower portion of the frontal frame, that allows the adjustment of the incline of this portion by several gradually fixed positions.

In accordance with another variant, the fabrics are wrapped up inside one of the structures of the longitudinal elements, with springs allowing an automatic rolling up, and thus solving the problem of the release of the fabrics from the whole structure before the folding.

The lounge chair as described above, presents a frame structure that allows a very satisfying stability and is capable of being fold as indicated, but however in which, certain elements imply in themselves a relatively expensive realization. Moreover, the number of hinges and thus the number of folding operations, constitutes an inconvenience despite the advantages such as stability when the chair is fully unfolded and the compactness when it is folded.

According to the invention, a second form of realization of a lounge chair, includes then components of carriage and folding, allowing the folding to a compact form thanks to operations easier than the previous, and particularly efficient Referring to FIGS. 6 to 12, the lounge chair in accordance with the second form of realization, is composed by a frame, advantageously in metallic sections, formed by two longitudinal elements 31 and 32, jointed with two hinges 33 and 34 in accordance with two crossaxles I—I and II—II respectively defining a central seat 35, an upper portion 36, and a lower portion 37. These three portions include a stretched fabric, either as three independent fabrics, or as only one continuing fabric, fastened to the longitudinal elements with exception of the areas where there are hinges. The central portion 35 includes two crosslegs 38 and 39, connected with connection joints to the hinges 33 and 34 on one hand provided with parallel axles to the axles of said hinges, and on the other hand provided with perpendicular axles to previous axles as will be explained with more detail below. The frame is also composed by two supporting crossbars 310, 311 at each of its ends. Each of these crossbars are hinged on one of the longitudinal elements according to an axle 312, so that it can revolve and be folded alongside the respective element, during the folding operation described below.

The legs 38 and 39 are cruciform, or have an X shape, with a free articulation 313 in their middle. Advantageously, the two branches of each leg are mounted on the same plane, in a way known in itself, with a profile such as they can be juxtaposed when the chair is folded, to limit the space they occupy. The hinge 313 includes no locking device, and thus allows a free movement to the two branches, each of these branches is provided with a thrust block 314 provided to limit the angle of aperture, if necessary.

The upper portion of each branch is connected to a connection joint arranged at the end of a longitudinal element 31, 32 of the seat 35. Thus, the seat includes four connection joints, which, for a purpose that will be better explained below, are divided in two types mounted in pairs, opposite to each other, onto the two longitudinal elements 31 and 32. As mentioned earlier, each connection joint is fastened to the respective hinge 33, 34, and includes essentially a first axle of revolution 315, parallel to the axle of the respective hinge, providing for the respective leg 38, 39 to be jointed to the longitudinal element 31, 32 of the seat, as well as with a second axle 316, more or less perpendicular to the first axle, providing for the opening and closing movement of the cruciform legs around their median articulation 313. Advantageously, hinges 33 have a notched sector 317, known in itself, to allow the adjustment of the incline of the upper portion 36, in relation to the seat 35, according to axle I—I. Besides, axles of joints I—I and II—II of hinges 33 and 34 are arranged out of alignment in a preferred way above the main plane, of the seat 35, to allow an easier and more compact folding of portions 36 and 37 over said seat 35.

Figure 10:
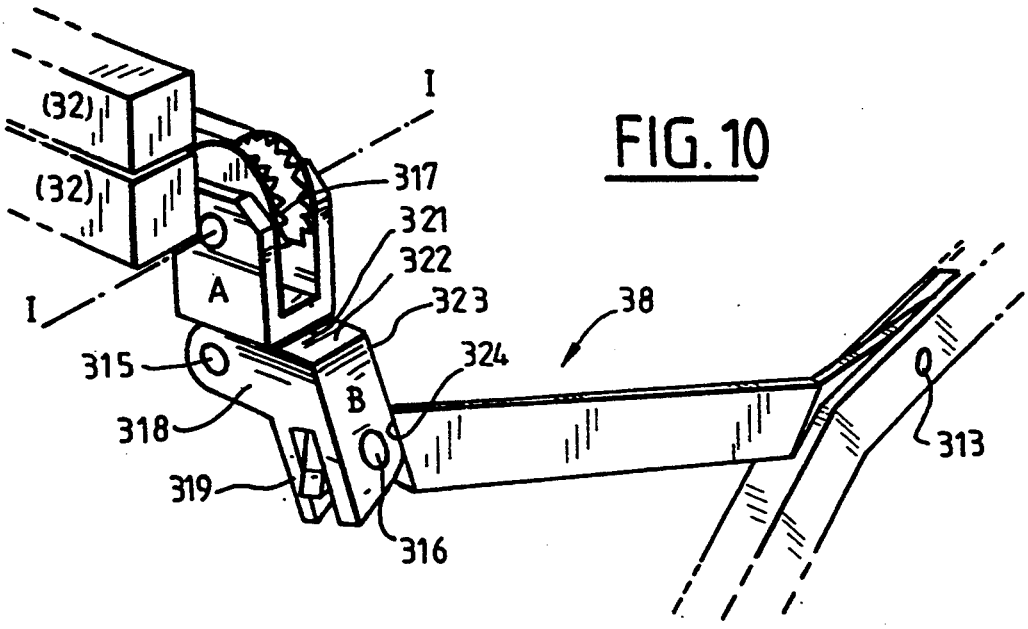
FIGS. 10 to 12 represent respectively, at an enlarged scale, a view in detail of two types of connection joints of the legs to the longitudinal elements.
Figure 11:
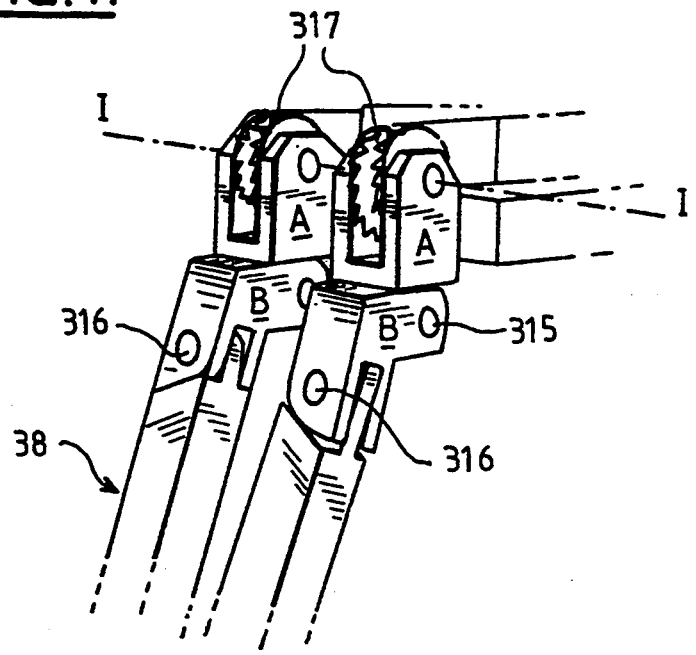
Figure 12:
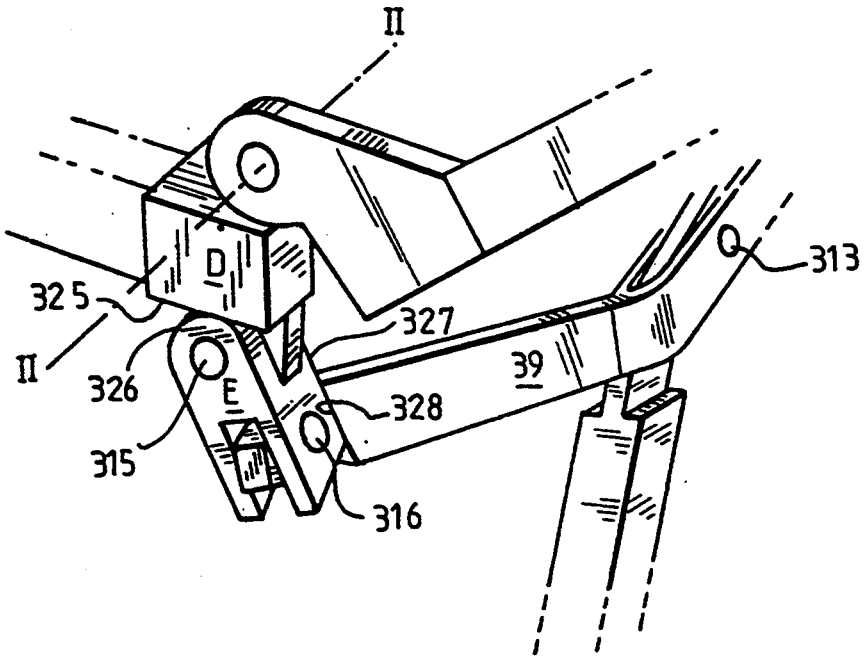

In reference to FIGS. 10 and 11, the hinges 33 include a frame A carrying axle I—I, fastened to the connection joint of leg 38 by an intermediate piece B fixed to said hinge, by the first revolving axle 315 of the parallel leg, whereas the second axle, 316 more or less perpendicular to the first axle retains the upper end of the branch of leg 38. In due course, note that piece B presents itself two extensions, 318 and 319, the length of extension 318, and the angle between the two extensions 318 and 319 being such as when in folded position some space is kept between leg 38, to which the piece is connected, and the longitudinal element of the seat, so that the opposite folded leg 39, can locate itself in this space (FIG. 9), and form a compact structure. The connection joint includes also locking sides 321 and 322, surface against surface, meaning the upper portion 322 of portion B can be brought together with lower side 321 of frame A to define an angle of incline of the unfolded legs, and a lateral side 323 of portion B can be brought together with side 324 of the end of corresponding branch of leg 38, to prevent the longitudinal elements of having a tendency, when loaded, to be inclined inwards around axle 316.

In reference to illustration 12, the hinge 34 of axle II—II, includes a frame D, and an intermediate straight piece E, provided with two revolving axles 315 and 316, respectively parallel and perpendicular to axle II—II. In the same way than previously, sides 325,326 between D and E on the one part, and 327, 328 between E and the end of the corresponding branch of leg 39 on the other part, have the function indicated above. Sides 322 and 326 are arranged so that when the ensemble is totally unfolded they are inclined in the opposite way to the plane constituted by the legs so that they increase the polygon of equilibrium of the chair.

Figure 8:
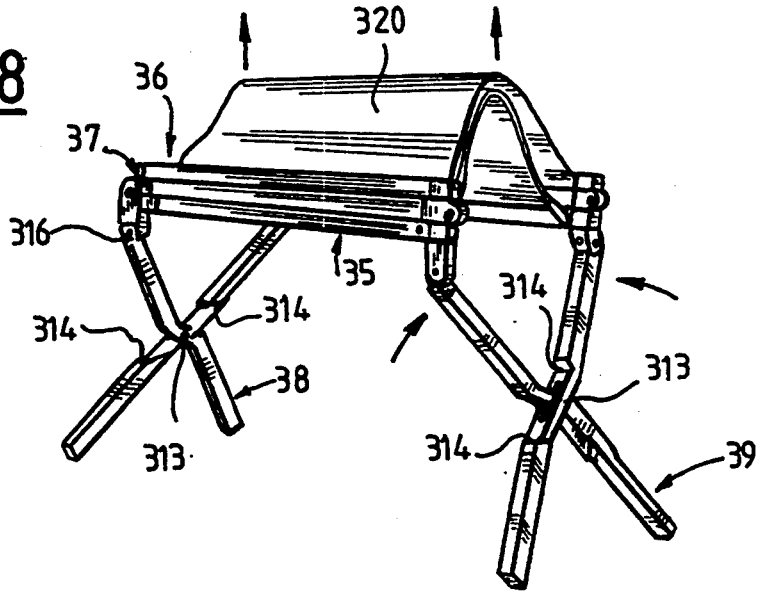
FIG. 8 represents a schematic view in perspective illustrating one of the last phases of the folding of the chair in FIG. 6.
Figure 9:
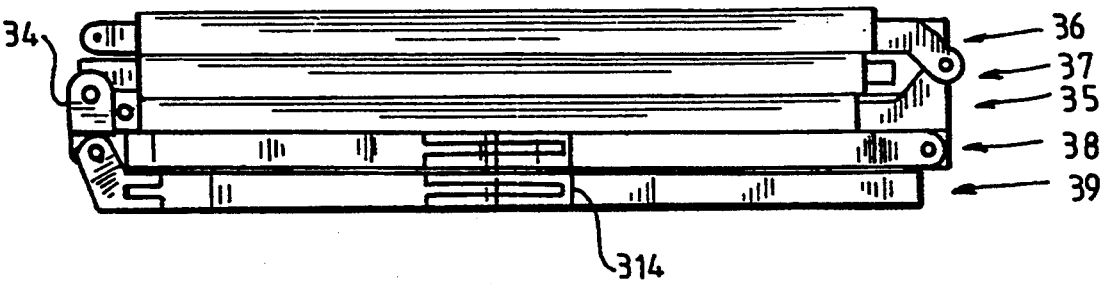
FIG. 9 represents a view of this chair totally folded.

As mentioned earlier, the operations of folding the lounge chair, which structure has just been described, are particularly easy and very few. Starting from the totally unfolded position as shown in FIG. 6, the folding at first starts with the unlocking of the crossbars 310 and 311, and their folding outwards, alongside the longitudinal elements they are fastened to (FIG. 7). Then the upper portion 36 is folded over the seat 35 by revolving around axle I—I (FIG. 7), and the lower portion is folded over the upper portion already folded (FIG. 8). To close the legs, which means to bring the longitudinal elements 31, 32 together, it then suffices to exert a simple traction on the slack fabrics 20 (FIG. 8). The compact position is obtained by folding the legs under the central seat 35 (FIG. 9), by the movement of the connection joints described above. The ensemble of the three fabrics 320, which, thanks to the layout of the frame, does not interfere with the joints and does not risk to get damaged, can be rolled up around the compact structure of the frame and maintained by any appropriate link, fastened for example to a shoulder strap.

Of course, the locking device 329 at the end of the mobil supporting crossbar 311 at the end of a longitudinal element 32 can be realized in any appropriate form known in itself.

In due course, we have to note that the locking device does not have to sustain any important efforts, as long as the crossbar maintains the distance between the longitudinal elements and that the fabric contributes when it is loaded, to the maintenance of the structure. It suffices that the length of the fabric, stretched between the two longitudinal elements 31, 32 corresponds more or less to the length of crossbars 310, 311.

As far as the crossbars 310, 311, are concerned, in the form of realization described above, their unlocking followed by the lying alongside a longitudinal element, implies a rotation of 270° around axle 312. In accordance with an advantageous variant, a bar in the form of a telescopic continuation of the longitudinal element can be realized including, inwardly, guides for axle 312 foreseen as a consequence, and devices to hold back said axle when the chair is unfolded. In these conditions the unfolding, followed by the unlocking implies only a rotation of 90° around axle 312 and inversely when folded to compact position.

In accordance with another simplified variant, the supporting bar may be totally disconnected from the longitudinal element to lie along the latter, by means of elastic components like clips, when the ensemble is folded, and get hooked to the end of the longitudinal element to maintain the opening of the frame when unfolded.

It is understood that the present invention has only been described and illustrated for explanation purposes, and certainly not restrictive purposes, and it shall be modified if useful, especially in the field of technical equivalences, without leaving its framework.

We claim:

1. A folding lounge chair, comprising a frame having a first element and a second frame element spanned by fabric attached to each said element, each said frame element having upper, central and lower portions separated by a first and a second hinge located between said upper and central, and central and lower portions, respectively; and, attached to said first frame element and second frame element, at least two cross members rotatingly attached at one end by a first connector to said first frame element and at least two legs attached to each said frame element adjacent to said hinges, wherein:

(a) said fabric includes a first, second and third fabric attached to corresponding upper, central and lower portions of said first frame element and second frame element forming a back rest, seat and leg rest, respectively;

(b) said upper portion folds forward at said first hinge to juxtapose said upper portion of each said frame element to an upper side of, and parallel to, the corresponding central portion;

(c) said lower portion folds at said second hinge in counter direction to said first hinge to juxtapose said lower portion of each said frame element to a lower side of, and parallel to, the corresponding central portion;

(d) said cross members maintain said frame elements in a fixed parallel position and also support weight placed on said fabric, said cross members being rotatable at said first connector on the first frame element to form a perpendicular cross piece connected to a corresponding portion of the second frame element when said chair is unfolded;

(e) when each said frame element has said portions and cross members in folded positions, said first and second frame element are juxtaposable against each other in parallel to form said folding lounge chair in a fully folded position;

(f) said fabric, when said chair is in a fully folded position, being positionable outside and around said fully folded lounge chair to form a protective cover; and a locking device which maintains said chair in a stabilized and locked position when said chair is in an unfolded position.

2. A lounge chair according to claim 1, wherein the legs are cruciform with free articulating middle branches, one end of each said leg being connected to said central portion of one of said frame elements by a second articulated connector, and wherein said second articulated connector comprises a first rotating axle and a second rotating axle substantially perpendicular to each other, the first axle articulating the leg relative and parallel to the central portion of the corresponding frame element, and the second axle providing opening and closing motion of the branches at a median joint, each said second articulated connector comprising locking faces, surface against surface, stabilizing the chair when in an unfolded position.

3. A lounge chair according to claim 2, wherein two branches of each leg have a shape allowing them to be juxtaposed in the folded position of the chair, said two branches of each leg being mounted when folded on the same plane as each said frame element.

4. A lounge chair according to claim 2, in which each cross member can be disconnected from the second frame element to lie along the first frame element when in folded position and hooked to the end of the second frame element to maintain the opening distance between each frame element when unfolded.

5. A lounge chair according to claim 2 wherein each said second articulated connector has intermediary pieces carrying said rotating axles, one of the pieces being provided with two extensions arranged at an angle which supports said frame when extended and which allows compact folding of said legs respectively against each said frame element and cross members.

6. A lounge chair according to claim 5, wherein said second articulated connector with intermediary pieces are mounted in pairs, facing each other, on corresponding portions of each frame element.

7. A lounge chair according to claim 5, wherein the surface against surface locking faces are mounted respectively on the intermediary piece and cooperate with sides disposed on a corresponding hinge and on the end of the branch of the corresponding leg which is articulated on said branch.

* * * * *